US007623039B2

(12) United States Patent
Liu

(10) Patent No.: US 7,623,039 B2
(45) Date of Patent: Nov. 24, 2009

(54) MAGNETOMECHANICAL TAG USED IN ELECTRONIC ARTICLE SURVEILLANCE AND METHOD OF MANUFACTURING A MAGNETOMECHANICAL TAG

(75) Inventor: Nen-Chin Liu, Wellington, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 194 days.

(21) Appl. No.: 11/493,410

(22) Filed: Jul. 25, 2006

(65) Prior Publication Data

US 2008/0030338 A1 Feb. 7, 2008

(51) Int. Cl.
*G08B 13/14* (2006.01)

(52) U.S. Cl. ..... 340/572.6; 340/572.1; 340/572.8

(58) Field of Classification Search ..... 340/572.1, 340/572.8, 572.5, 572.6, 551, 572.7; 29/602.1, 29/25.35

See application file for complete search history.

(56) References Cited

U.S. PATENT DOCUMENTS 5,141,659 A * 8/1992 Kashiwaya et al. ..... 508/137
5,499,015 A * 3/1996 Winkler et al. ..... 340/572.2
5,759,422 A 6/1998 Schmelzer et al.
5,790,029 A * 8/1998 Curnutte et al. ..... 340/572.1
6,182,352 B1 * 2/2001 Deschenes et al. ..... 29/602.1
6,359,444 B1 * 3/2002 Grimes ..... 324/633
7,365,686 B2 * 4/2008 Sakama et al. ..... 343/700 MS

FOREIGN PATENT DOCUMENTS

WO WO 95/29534 A1 11/1995

OTHER PUBLICATIONS

EPO International Search Report and Written Opinion dated Apr. 5, 2007 for corresponding appln PCT/US2007/028994.

* cited by examiner

*Primary Examiner*—Anh V La
(74) *Attorney, Agent, or Firm*—Alan M. Weisberg; Christopher & Weisberg, P.A.

(57) ABSTRACT

A magnetomechanical tag for use in an electronic article surveillance (EAS) system and a method of manufacturing the magnetomechanical tag may be provided. The EAS may include at least one resonator, a housing configured to allow vibration therein of the at least one resonator and a cover heat sealed to the housing at a heat sealing temperature. The EAS tag further may include a powder lubricant within the housing. The powder lubricant may have a melting temperature less the heat sealing temperature.

20 Claims, 5 Drawing Sheets

MAGNETOMECHANICAL TAG USED IN ELECTRONIC ARTICLE SURVEILLANCE AND METHOD OF MANUFACTURING A MAGNETOMECHANICAL TAG

BACKGROUND OF THE INVENTION

1. Field of the Invention

This invention relates generally to magnetomechanical tags used in electronic article surveillance (EAS) systems, and more particularly, to methods for manufacturing EAS tags.

2. Description of the Related Art

In acoustomagnetic or magnetomechanical electronic article surveillance, or "EAS," a detection system may excite an EAS tag by transmitting an electromagnetic burst at a resonance frequency of the tag. When the tag is present within an interrogation zone defined by the electromagnetic field generated by the burst transmitter, the tag resonates with an acoustomagnetic or magnetomechanical response frequency that is detectable by a receiver in the detection system.

EAS systems may be provided to prevent or deter theft of merchandise from retail establishments. In a typical EAS system, EAS tags configured to interact with an electromagnetic or magnetic field generated by equipment placed, for example, at an exit of a store are utilized. Removable EAS tags that may be configured as labels are typically placed on the article at the store or at an intermediate location. Alternatively, EAS tags or labels may be integrated into the article during manufacture in a process known as "source tagging."

If an EAS tag is brought into the field or interrogation zone of the field generating equipment, the presence of the tag is detected and an alarm may be generated, such as a visual or audible alarm. Removable EAS tags are typically removed at the checkout counter upon payment for the merchandise. Other types of EAS tags, such as EAS tags integrated with the article, are deactivated at the checkout counter, for example, by a deactivation device that changes an electromagnetic or magnetic characteristic of the EAS tag such that the presence of the EAS tag will no longer be detected within the interrogation zone.

EAS tags are typically assembled in a stacking or layering process wherein the various component parts are attached and sealed together. During the assembly process, a powder lubricant is applied to reduce the friction between some of the component parts (e.g., between a resonator and substrate). The applied powder lubricant is typically not applied in a controlled process and may affect the heat sealing of the EAS tag, for example, not allow proper or complete sealing of the EAS tag because too much powder lubricant is applied. Also, because the applied powder lubricant process is not controlled, too little powder lubricant may be applied resulting in increased friction within the EAS tag and a potential reduction of tag signal amplitude. Thus, the addition of too little or too much powder lubricant affects the assembly and operation of the EAS tags.

BRIEF DESCRIPTION OF THE INVENTION

An electronic article surveillance (EAS) tag may be provided that may include at least one resonator, a housing configured to allow vibration therein of the at least one resonator and a cover heat sealed to the housing at a heat sealing temperature. The EAS tag further may include a powder lubricant within the housing. The powder lubricant may have a melting temperature less than the heat sealing temperature.

A method for sealing an electronic article surveillance (EAS) tag also may be provided. The method may include applying a powder lubricant to a sealing portion of the EAS tag and heat sealing the sealing portion by melting the powder lubricant.

A method for assembling an electronic article surveillance (EAS) tag further may be provided. The method may include positioning a lidstock cover over a coverstock housing such that an edge of the lidstock cover aligns with an edge of a flange of the coverstock housing. The method also may include heating the flange of the coverstock housing wherein a bonding layer comprising a powder lubricant melts to seal the lidstock cover and the coverstock housing.

BRIEF DESCRIPTION OF THE DRAWINGS

For a better understanding of various embodiments of the invention, reference should be made to the following detailed description that should be read in conjunction with the following figures wherein like numerals represent like parts.

DETAILED DESCRIPTION OF THE INVENTION

For simplicity and ease of explanation, the invention will be described herein in connection with various embodiments thereof. Those skilled in the art will recognize, however, that the features and advantages of the various embodiments may be implemented in a variety of configurations. It is to be understood, therefore, that the embodiments described herein are presented by way of illustration, not of limitation.

In general, various embodiments of the present invention provide an electronic article surveillance (EAS) tag for use in connection with an EAS system. It should be noted that when reference is made herein to an EAS tag, this includes any type of EAS marker or label, whether removably attached or integrated with an object and that generally includes a magnetomechanical structure that includes one or more magnetostrictive resonating elements. Further, an EAS tag formed in accordance with various embodiments of the invention may used in different types of EAS systems, including, for example, any mechanical resonance type EAS system, among others.

Figure 1:
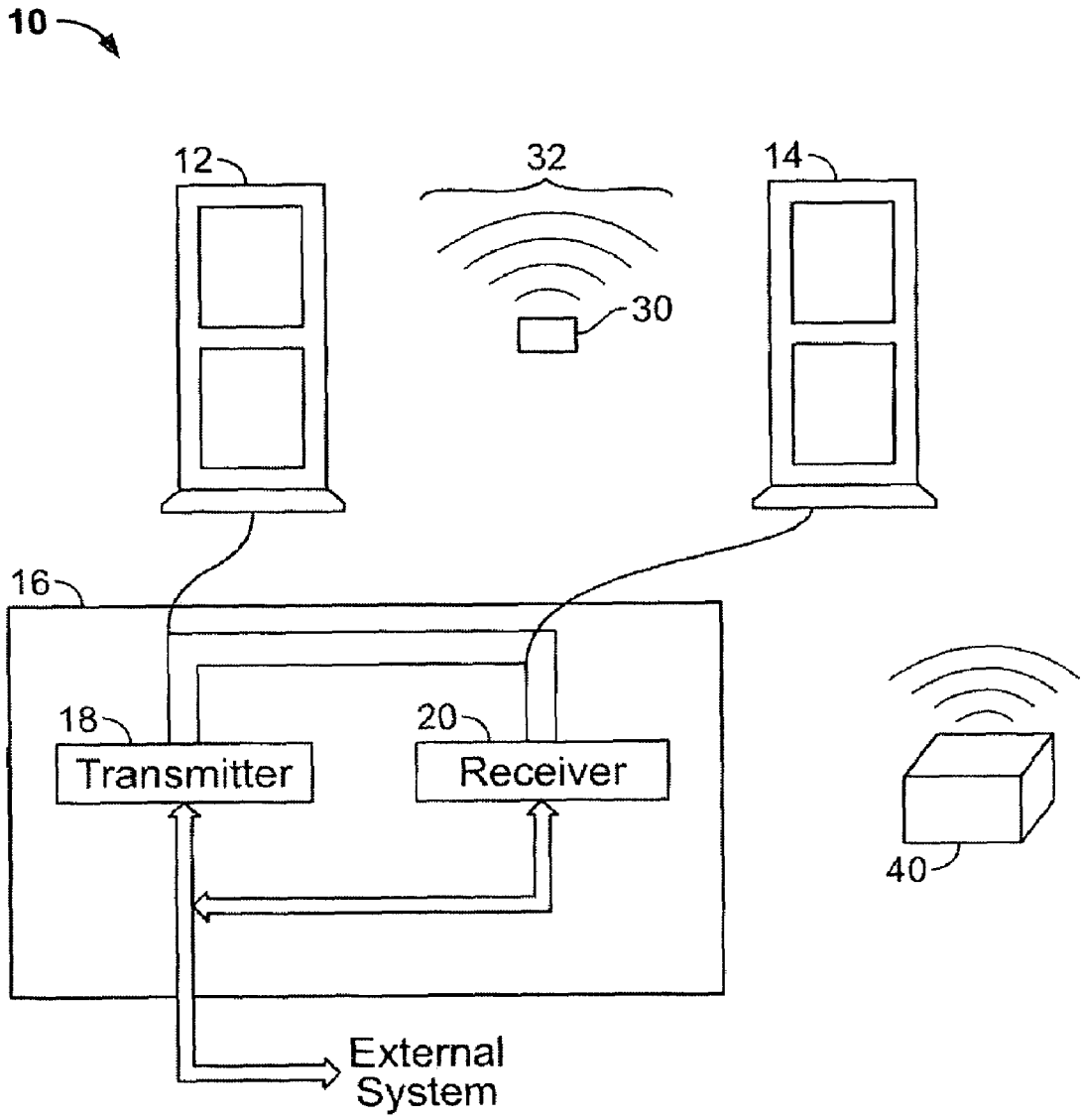
FIG. 1 is a diagram of an electronic article surveillance system illustrating a magnetomechanical label within a field of interrogation generated by the system.

FIG. 1 illustrates an EAS system 10 that may include a first antenna pedestal 12 and a second antenna pedestal 14. The antenna pedestals 12 and 14 may be connected to a control unit 16 that may include a transmitter 18 and a receiver 20. The control unit 16 may be configured for communication with an external device, for example, a computer system controlling or monitoring operation of a number of EAS systems. In addition, the control unit 16 may be configured to control transmissions from the transmitter 18 and receptions at the receiver 20 such that the antenna pedestals 12 and 14 can be utilized for both transmission of signals for reception by an EAS tag 30 and reception of signals generated by the excitation of EAS tag 30. Specifically, such receptions typically occur when the EAS tags 30 are within an interrogation zone 32, which is generally between the antenna pedestals 12 and 14.

The system 10 is representative of many EAS system embodiments and is provided as an example only. For example, in an alternative embodiment, the control unit 16 may be located within one of the antenna pedestals 12 and 14. In still another embodiment, additional antennas that only receive signals from the EAS tags 30 may be utilized as part of the EAS system. Also, a single control unit 16, either within a pedestal or located separately, may be configured to control multiple sets of antenna pedestals. As is known, a deactivation device 40, for example, incorporated into the checkout counter of a retailer, may be utilized to degauss the EAS tags 30 upon purchase of the item to which, or into which, the EAS tag 30 is attached or integrated.

Figure 2:
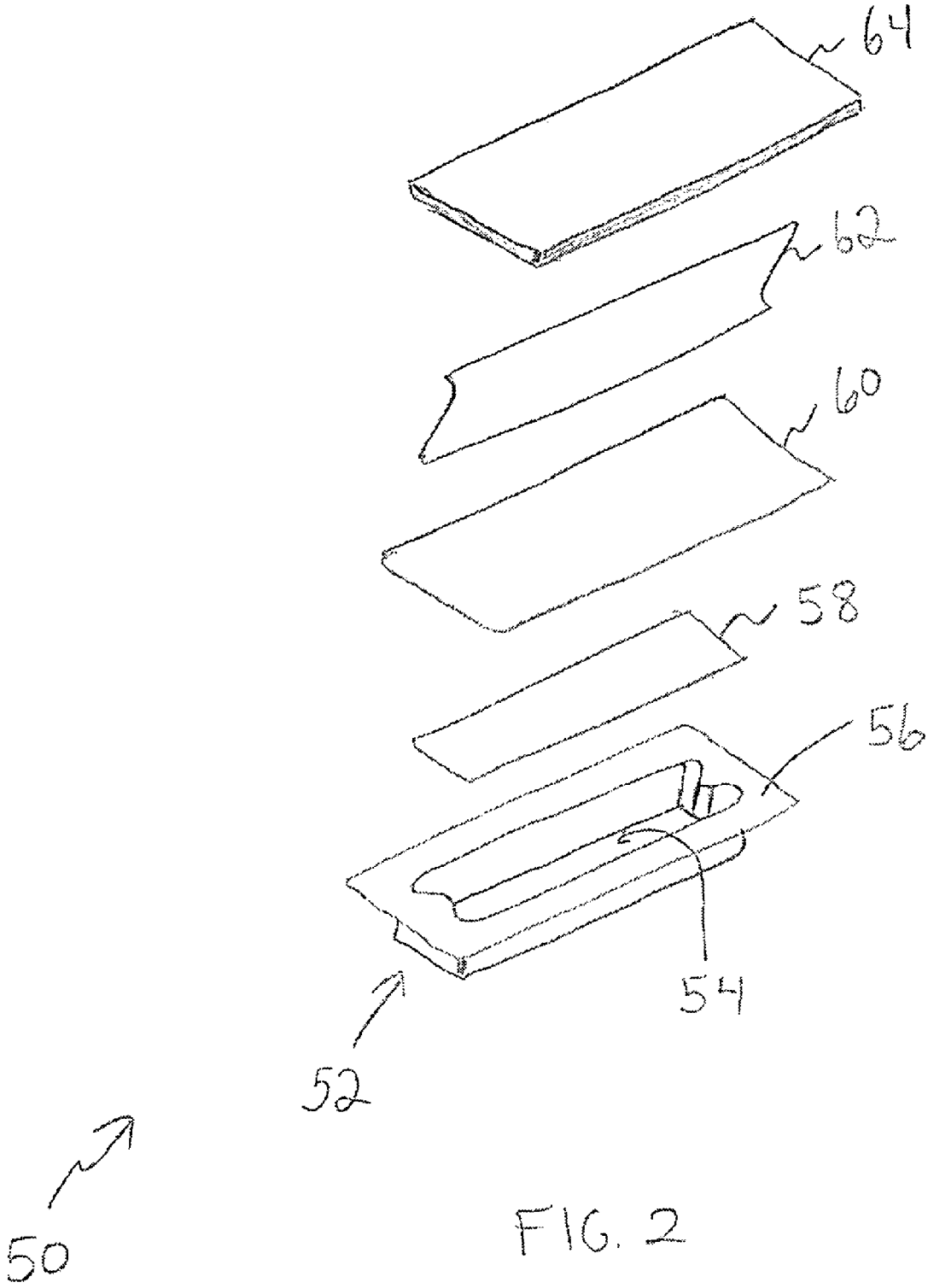
FIG. 2 is a diagram of an EAS tag formed in accordance with an embodiment of the invention.

FIG. 2 is an illustration of an embodiment of a magneto-mechanical EAS tag 50, which is also sometimes referred to as an EAS label. The EAS tag 50 may include a housing 52 having a cavity 54 formed therein and a flange 56 extending around an upper surface of the housing 52. The flange 56 may extend generally around an upper edge of the housing 52 and may form a lip extending perpendicular to the top edge. The EAS tag 50 further may include one or more magnetostrictive resonators 58 (only one shown in FIG. 2) that may be located in the cavity 54. The cavity 54 may be sized and shaped to provide sufficient space for the one or more resonators 58 to vibrate at a resonant frequency. The resonant frequency of the one or more resonators 58 may be determined, at least in part, by a length and width of the one or more resonators 58 and a strength of a magnetic field near the one or more resonators 58. A cover 60, commonly referred to as a lidstock layer, may be positioned on the housing 52, and more particularly, abutting against the flange 56 and sealed (e.g., heat sealed) thereto as described in more detail herein.

A biasing element 62 may be provided on top of the cover 60 and attached thereto (e.g., adhesively bonded thereto) using an adhesive layer 64, which may be a double-sided adhesive layer. The biasing element 62 may be formed of any hard or semi-hard metallic element that biases the one or more resonators 58.

In operation, after fully saturating the biasing element 62 through magnetization, the EAS tag 50 is in the active state. The resonant frequency and amplitude of the resonant frequency generated within EAS tag 50 may be optimized for a particular detection algorithm based on a field strength provided by the biasing element 62. The EAS tag 50 may be attached to an object using various methods, for example, with one side of the adhesive layer 64. The EAS tag 50 alternatively may be contained within the packaging of other objects or items. Also, the EAS tags 50 may be permanently embedded within certain objects (e.g., molded within the object) during production of the object.

Figure 3:
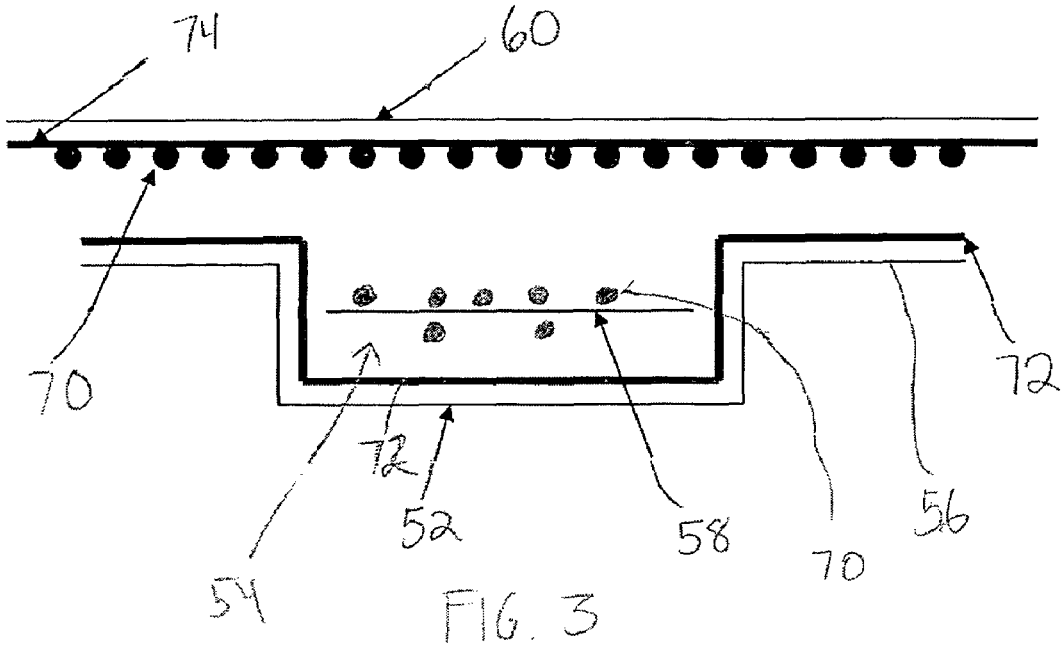
FIG. 3 is a side elevation view of an EAS tag formed in accordance with an embodiment of the invention in an unsealed state.

FIG. 3 is an illustration of an embodiment of an EAS tag 50 that may include a powder lubricant 70 applied thereto. For example, the powder lubricant 70 may be applied to coat or partially coat a portion of the EAS tag 50. The powder lubricant 70 may be applied in an even pattern or an uneven pattern. Additionally, the powder lubricant 70 may be provided within the cavity 54 and in contact with the one or more resonators 58. The powder lubricant 70 may be applied during an assembly stage of the EAS tag 50 as described in more detail below or during the manufacture of the cover 60.

The powder lubricant 70 may be formed from a low melting temperature powder lubricant, for example, having a melting temperature of less than 110 degrees Celsius, and more particularly, less than a sealing temperature for sealing the EAS tag 50. For example, the powder lubricant 70 may be formed from a low density polyethylene (LDPE) material having a melting point at or below a heat sealing temperature for the EAS label 50, for example, at or below 110 degrees Celsius. In general, the powder lubricant 70 may be formed from different powder materials having different particle sizes, for example, based on the application or type of use. In various embodiments, and for example, the powder lubricant 70 may be formed from the following materials:

1. High Density Polyethylene (HDPE). (approximate particle size of 60 microns)
2. Medium Density Polyethylene (MDPE). (approximate particle size of 60 microns)
3. Low Density Polyethylene (LDPE). (approximate particle size of 20 microns)
4. Polyethylene (PE) Oxide (approximate particle size less than 45 microns).
5. Oxy-Dry powder (approximate particle size of 26 microns) available from Oxy-Dry Corporation.

Other materials may be used to form the powder lubricant 70 as needed or desired, for example, based on the particular application or type of EAS system 10 or EAS tag 50.

The housing 52 may be formed from a coverstock material that may be configured as a multi-ply arrangement. The coverstock material may comprise, for example, a polystyrene material. A coverstock bonding layer 72 also may be provided on a top surface of the housing 52 including within the cavity 54 and on the flange 56. The coverstock bonding layer 72 may be formed from, for example, an LDPE material having a melting point close to the sealing temperature (e.g., 110 degrees Celsius). The coverstock bonding layer 72 may provide a bonding layer during a heat sealing stage at a temperature slightly higher than 110 degrees Celsius, for example, 112 degrees Celsius. The cover 60 may be formed from a lidstock material that may be configured as a multi-ply arrangement. The lidstock material may comprise, for example, a polyethylene terephthalate (PET) material. A lidstock bonding layer 74 also may be provided on a bottom surface of the housing 60 and formed from an LDPE material having similar properties to the coverstock bonding layer 72.

Figure 4:
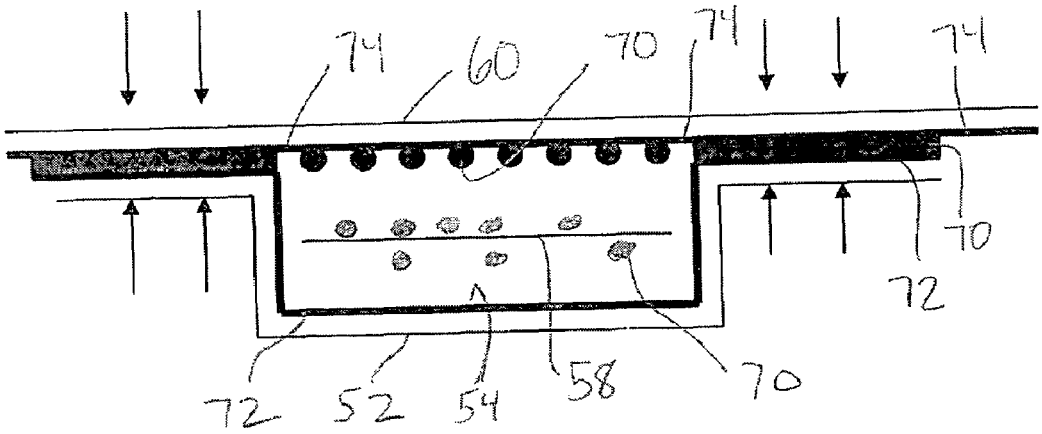
FIG. 4 is a side elevation view of an EAS tag formed in accordance with an embodiment of the invention in a sealed state.

Accordingly, when sealing the EAS tag 50 using any known process, for example, applying heat to the flange 56 areas as illustrated by the arrows in FIG. 4, the powder lubricant 70 located on the flange 56 melts, and together with the coverstock bonding layer 72 and the lidstock bonding layer 74 that also melt, seals the cover 60 to the housing 52 (e.g., powder lubricant 70 forms a sealing layer with the coverstock bonding layer 72 and the lidstock bonding layer 74). This sealing engagement also may seal the one or more resonators 58 within the cavity 54.

Figure 5:
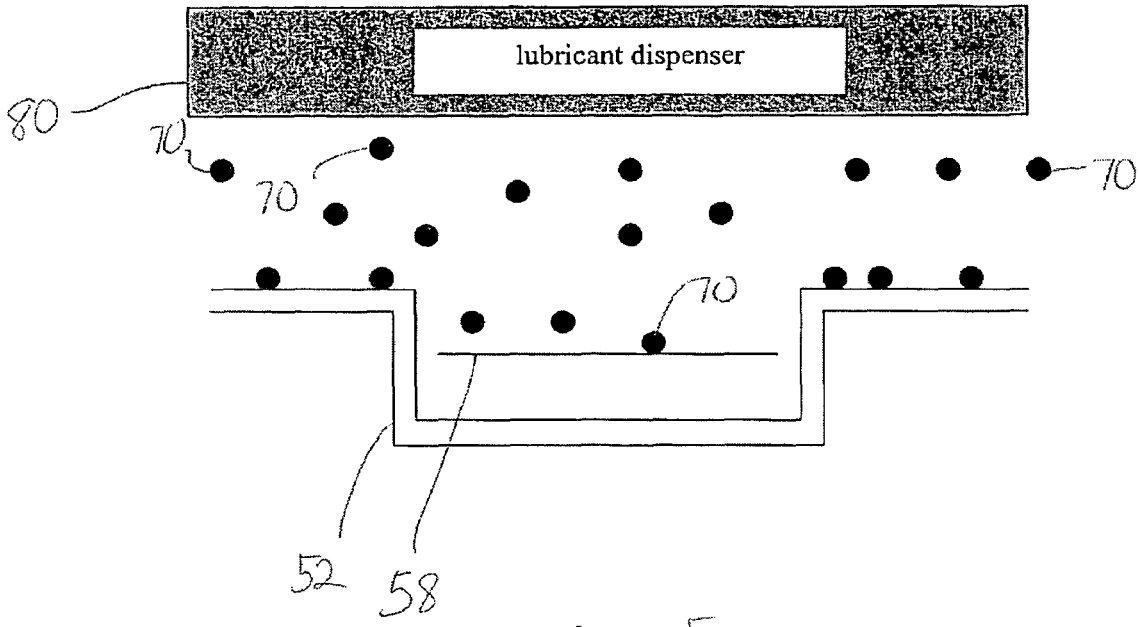
FIG. 5 is a side elevation view of an EAS tag formed in accordance with an embodiment of the invention illustrating a lubricant dispenser dispensing powder lubricant in the EAS tag.
Figure 6:
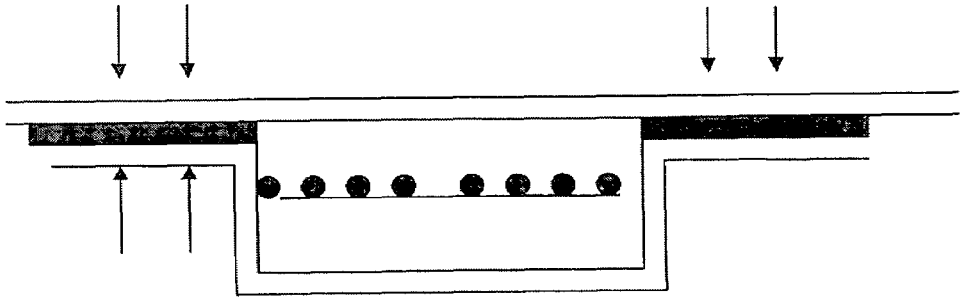
FIG. 6 is a side elevation view of an EAS tag formed in accordance with another embodiment of the invention in a sealed state.

In an alternative embodiment shown in FIGS. 5 and 6, the coverstock bonding layer 72 and the lidstock bonding layer 74 may be removed from the EAS tag 50 and the powder lubricant 70 may form the seal between the cover 60 and the housing 52 along the flange 56. In this embodiment, the powder lubricant 70 may be applied during the assembly stage, for example, by a lubricant dispenser 80. For example, the lubricant dispenser 80 may dispense powder lubricant 70 through openings (not shown) for a predetermined period of time for each EAS tag 50. However, the dispensing of the powder lubricant 70 by the lubricant dispenser 80 may be provided in any manner using any dispensing means. The lubricant dispenser 80 may be provided on top of a sheet of the coverstock to apply the powder lubricant 70, for example, evenly apply the powder lubricant 70 on the flange 56 and within the cavity 54 having the one or more resonators 58 therein. Again, the powder lubricant 70 may be an LDPE material that melts at the surface of the flange 58 during the sealing process and as shown in FIG. 6. The powder lubricant 70 may form the seal or bond between the cover 60 and the flange 58 sealing the one or more resonators 58 within the cavity 54. Thus, the powder lubricant 70 provides friction reduction within the cavity 54 and sealing of the cover 60 to the flange 56.

Figure 7:
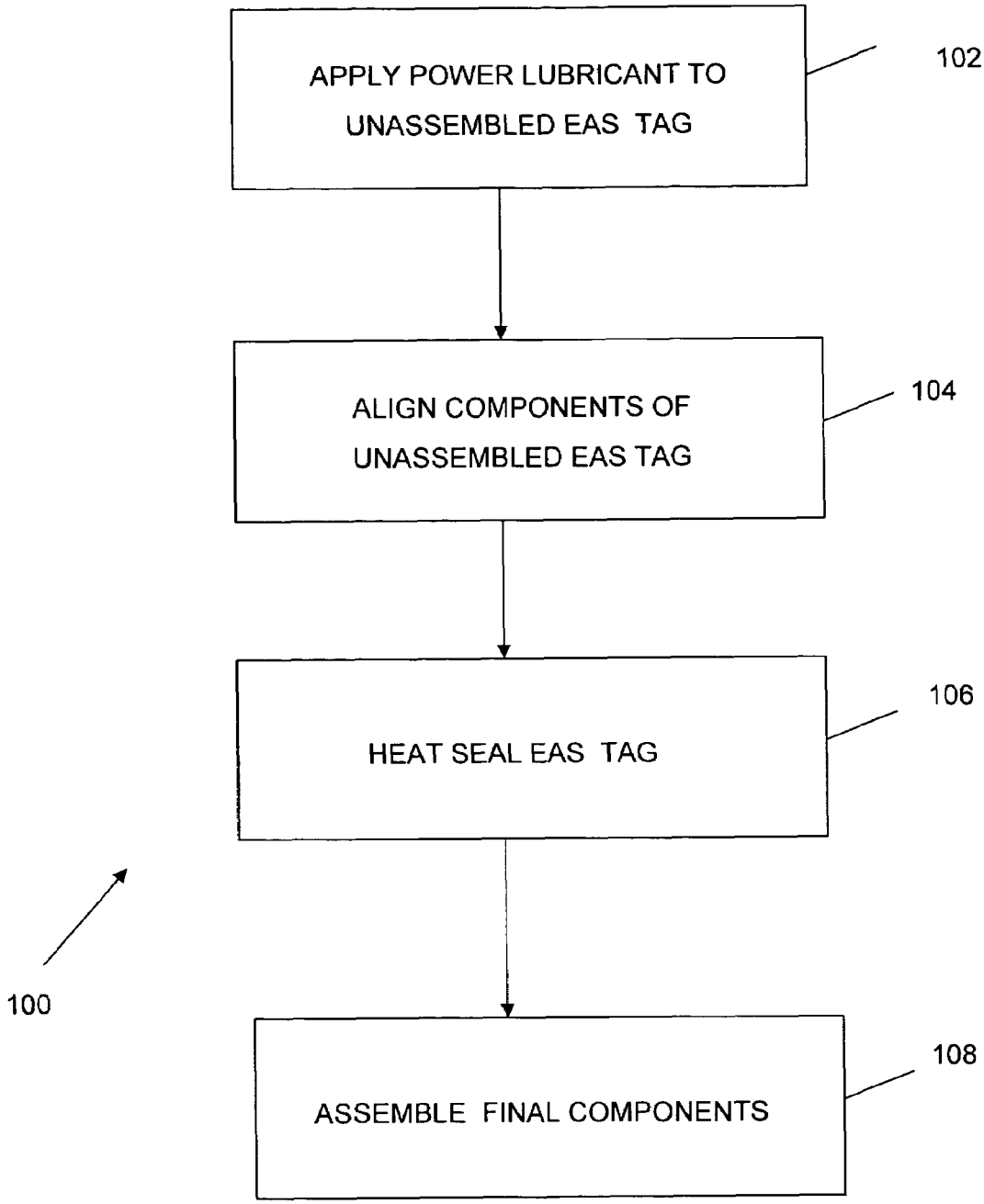
FIG. 7 is a flowchart of method for sealing an EAS tag in accordance with an embodiment of the invention.

A method 100 for sealing an EAS tag 50 is illustrated in FIG. 7. At 102 a powder lubricant may be applied to the EAS tag 50. For example, the powder lubricant 70 may be dispensed on the EAS tag 50, and more particularly, at least within the cavity 54 and along the flange 56. The powder lubricant 70 may be applied in an evenly distributed manner or unevenly/randomly. The application of the powder lubricant 70 may be provided in any known manner, for example, by spraying, blowing, dropping, spreading, dusting, etc. the powder lubricant 70 to the surfaces of the cavity 54 and the flange 56. During the powder lubricant application process powder lubricant 70 also may be applied to other surfaces of the EAS tag 50 either intentionally or unintentionally. The amount of powder lubricant 70 applied may be controlled, for example, by timing the duration of the powder lubricant application, measuring the amount of powder lubricant 70 to be applied, etc. However, in an alternative embodiment, the powder lubricant 70 is not applied in a controlled process, but manually, for example, by hand using a shaker bottle containing the powder lubricant 70. The amount applied may be based on, for example, the type of powder lubricant 70 or the application or use for the EAS tag 50.

In another embodiment, in addition to or instead of applying the powder lubricant 70 to the flange 56 of the housing 52, bonding layers may be provided, for example, the coverstock bonding layer 72 and the lidstock bonding layer 74. In this embodiment, the powder lubricant 70 may (i) not be applied, (ii) applied within the cavity 58 with any excess coating the bonding layers and/or (iii) applied to one or more of the bonding layers.

The powder lubricant 70 may be formed of a material that melts during a sealing process of the EAS tag 50. For example, the powder lubricant 70 may be formed from a low melting temperature powder lubricant 70, for example, having a melting temperature of less than the sealing temperature for the EAS tag 50 (e.g., 110 degrees Celsius). For example, the powder lubricant 70 may be formed from a low density polyethylene (LDPE) material having a melting point at or below a heat sealing temperature for the EAS label 50, such as a polyethylene composite material or a PE oxide material.

Thereafter, at 104 the components of the unassembled EAS tag 50 including the powder lubricant coated components may be aligned. For example, the cover 60 may be aligned on top of the housing 52 having the one or more resonators 58 therein. The alignment may include aligning the edges of the cover 60 with the edges of the flange 56. Once the components are aligned, a heat source may apply heat at 106 to the aligned components to heat seal the components, for example, heat seal the cover 60 to the housing 52. This sealing engagement also may seal the one or more resonators 58 within the cavity 54. The heat source may be any type of heating device capable of applying directed heat to the components or portions of the components of the EAS tag 50. The heat source may direct heat only to portions of the components to be sealed, for example, along the flange 56. The portions having one of the powder lubricant 70 and the bonding layers therebetween that are heated are bonded or sealed together. More particularly, the application of the heat from the heat source melts either the powder lubricant 70, the bonding layers, or both depending on which of these materials is provided between the portions of the components to be sealed. In one embodiment, the heat level is provided such that the temperature is above the melting point of one of the powder lubricant and the bonding layers. For example, the melting point of the powder lubricant 70 may be lower than the melting point of the bonding layers such that any powder lubricant 70 present with the bonding layers also melts upon or before reaching the melting point of the bonding layers. In another embodiment, wherein only the powder lubricant 70 may be melted during the sealing process (e.g., when no bonding layers are present), the powder lubricant 70 may be formed of a material that has a melting point either less than the melting point of the bonding layer (such that the same heating source may be used if the bonding layers are present) and/or less than a temperature that would caused damage to the material forming the housing 54 (e.g., causing the housing 54 to deform or melt).

Once sealed, for example, once the cover 60 is sealed to the flange 56 of the housing 52, at 108 additional components may be added to the EAS tag 50. For example, a bias member 62 may be adhered to the top of the cover 60 using an adhesive layer 64, which may be a double-sided adhesive layer.

Thus, various embodiments provide a powder lubricant that may be used to seal an EAS tag. The powder lubricant may be used in combination with other bonding materials or may be used alone to seal, for example, one or more resonators within a housing of the EAS tag.

While the invention has been described in terms of various specific embodiments, those skilled in the art will recognize that the various embodiments of the invention can be practiced with modification within the spirit and scope of the claims.

What is claimed is:

1. An electronic article surveillance (EAS) tag comprising:

at least one resonator;

a housing having a sealing portion, the housing being configured to allow vibration therein of the at least one resonator;

a cover heat sealed to the sealing portion of the housing at a heat sealing temperature; and a powder lubricant within the housing, the powder lubricant applied to the sealing portion of the housing and to the at least one resonator, the powder lubricant having a melting temperature less than the heat sealing temperature.

2. An EAS tag in accordance with claim 1 wherein the sealing portion is a flange.

3. An EAS tag in accordance with claim 1 wherein the powder lubricant forms a heat sealed bond sealing the cover to the sealing portion.

4. An EAS tag in accordance with claim 1 wherein the sealing portion comprises a flange having a bonding layer formed from a material having a melting temperature greater than the melting temperature of the powder lubricant and less than or about equal to the heat sealing temperature.

5. An EAS tag in accordance with claim 1 wherein the cover further comprises a bonding layer formed from a material having a melting temperature greater than the melting temperature of the powder lubricant and less than or about equal to the heat sealing temperature.

6. An EAS tag in accordance with claim 1 wherein at least one of the sealing portion and cover comprises a bonding layer formed from a low density polyethylene (LDPE) material.

7. An EAS tag in accordance with claim 1 wherein the cover includes the powder lubricant on at least a portion of the cover.

8. An EAS tag in accordance with claim 1 wherein the powder lubricant comprises one of a low density polyethylene (LDPE) material, a medium density polyethylene (MDPE) material, a high density polyethylene (HDPE) and a polyethylene (PE) oxide material.

9. An EAS tag in accordance with claim 1 wherein the heat sealing temperature is substantially 110 degrees Celsius.

10. An EAS tag in accordance with claim 1 wherein the sealing portion is a flange and the powder lubricant is applied to the housing by a lubricant dispenser.

11. An EAS tag in accordance with claim 10 wherein the powder lubricant is applied evenly to the flange.

12. A method for sealing an electronic article surveillance (EAS) tag, the method comprising:

applying a powder lubricant to a sealing portion of the EAS tag and to at least one resonator to lubricate the at least one resonator, the powder lubricant having a melting temperature less than a heat sealing temperature; and heat sealing the sealing portion by melting the powder lubricant.

13. A method in accordance with claim 12 further comprising applying a powder lubricant within a housing portion of the EAS tag.

14. A method in accordance with claim 12 wherein the sealing portion comprises a bonding layer and the heat sealing comprises applying heat at a temperature to melt the bonding layer, with the melting temperature of the powder lubricant less than the melting temperature of bonding layer.

15. A method in accordance with claim 12 wherein the heat sealing comprises applying heat at a temperature of substantially 110 degrees Celsius.

16. A method in accordance with claim 12 further comprising applying a powder lubricant to a cover portion of the EAS tag.

17. A method in accordance with claim 12 wherein the applying comprises dispensing the powder lubricant from a lubricant dispenser directly on the EAS tag.

18. A method for assembling an electronic article surveillance (EAS) tag, the method comprising:

positioning a lidstock cover over a coverstock housing such that an edge of the lidstock cover aligns with an edge of a flange of the coverstock housing;

applying a powder lubricant to the flange of the coverstock housing and to at least one resonator inside the coverstock housing, the powder lubricant having a melting temperature less than a heat sealing temperature; and heating the flange of the coverstock housing wherein a bonding layer comprising the powder lubricant melts to seal the lidstock cover and the coverstock housing.

19. A method in accordance with claim 18 wherein the bonding layer comprises a heat sealing material, and wherein the powder lubricant has a melting temperature lower than the melting temperature of the heat sealing material.

20. A method in accordance with claim 18 wherein the powder lubricant comprises a low density polyethylene (LDPE) material.

* * * * *